US009670717B2

(12) United States Patent
Anderson, Jr. et al.

(10) Patent No.: US 9,670,717 B2
(45) Date of Patent: Jun. 6, 2017

(54) FLOOD VENT TRIGGER SYSTEMS

(71) Applicant: Smart Vent Products, Inc., Pitman, NJ (US)

(72) Inventors: Winfield Scott Anderson, Jr., Palm Beach Gardens, FL (US); Tom Little, Pitman, NJ (US); James Rycek, Pitman, NJ (US); Michael J. Graham, Pitman, NJ (US)

(73) Assignee: SMART VENT PRODUCTS, INC., Pitman, NJ (US)

( * ) Notice: Subject to any disclaimer, the term of this patent is extended or adjusted under 35 U.S.C. 154(b) by 0 days.

(21) Appl. No.: 15/193,779

(22) Filed: Jun. 27, 2016

(65) Prior Publication Data

US 2016/0298383 A1 Oct. 13, 2016

Related U.S. Application Data

(62) Division of application No. 14/681,207, filed on Apr. 8, 2015, now Pat. No. 9,376,803.

(51) Int. Cl.

| | |
|---|---|
| ***E04H 9/14*** | (2006.01) |
| ***E06B 9/00*** | (2006.01) |
| ***E04B 1/70*** | (2006.01) |
| ***E02B 7/40*** | (2006.01) |
| ***E04C 1/39*** | (2006.01) |
| ***E04C 2/52*** | (2006.01) |

(Continued)

(52) U.S. Cl.

CPC ..... *E06B 9/00* (2013.01); *E02B 7/40* (2013.01); *E04B 1/70* (2013.01); *E04B 1/7069* (2013.01); *E04B 1/7076* (2013.01); *E04B 1/72* (2013.01); *E04C 1/392* (2013.01); *E04C 2/521* (2013.01); *E04H 9/145* (2013.01); *E06B 9/04* (2013.01); *E06B 2009/007* (2013.01)

(58) Field of Classification Search

CPC combination set(s) only.

See application file for complete search history.

(56) References Cited

U.S. PATENT DOCUMENTS

| | | | |
|---|---|---|---|
| 73,159 | A | 1/1868 | Bessb |
| 100,623 | A | 3/1870 | Hays |

(Continued)

FOREIGN PATENT DOCUMENTS

| | | |
|---|---|---|
| AU | 2008100183 | 5/2008 |
| EP | 2273056 | 1/2011 |

(Continued)

OTHER PUBLICATIONS

Office action mailed in U.S. Appl. No. 14/681,213, dated Oct. 13, 2015.

(Continued)

*Primary Examiner* — Kyle Armstrong

(74) *Attorney, Agent, or Firm* — Akerman LLP

(57) ABSTRACT

A flood vent includes a door pivotable within a frame between a closed position and an open position. A fluid trigger that is triggerable by a fluid to allow the door to pivot from the closed position to the open position includes a retainer and a fluid modifiable material. The fluid modifiable material is positioned between the door and the retainer thereby obstructing the door from pivoting from the closed position to the open position until the fluid modifiable material is modified by contact with the fluid.

12 Claims, 14 Drawing Sheets

(51) Int. Cl.
*E04B 1/72* (2006.01)
*E06B 9/04* (2006.01)

(56) References Cited

U.S. PATENT DOCUMENTS

| | | | | |
|---|---|---|---|---|
| 314,865 | A | 3/1885 | Monger | |
| 735,053 | A | 8/1903 | Bates | |
| 850,441 | A | 4/1907 | McGinnis | |
| 921,129 | A | 2/1909 | Burkett | |
| 1,089,232 | A | 3/1914 | Larson | |
| 2,105,735 | A * | 1/1938 | Hodge | B65D 90/34 292/265 |
| 2,118,535 | A | 5/1938 | Betts | |
| 2,565,122 | A | 8/1951 | Cowan | |
| 2,611,310 | A | 9/1952 | Cowan | |
| 2,774,116 | A | 12/1956 | Wolverton | |
| 2,798,422 | A | 7/1957 | Bourque | |
| 3,123,867 | A | 3/1964 | Combs | |
| 3,425,175 | A | 2/1969 | Gerde | |
| 3,680,329 | A | 8/1972 | Burtis | |
| 3,683,630 | A | 8/1972 | Alexandre | |
| 3,927,709 | A | 12/1975 | Anderson et al. | |
| 3,939,863 | A | 2/1976 | Robison | |
| 3,942,328 | A | 3/1976 | Bunger | |
| 3,974,654 | A | 8/1976 | Mirto et al. | |
| 3,978,616 | A | 9/1976 | Pennock | |
| 4,048,771 | A | 9/1977 | Thistlethwaite | |
| 4,116,213 | A | 9/1978 | Kamezaki | |
| 4,146,346 | A | 3/1979 | Salo | |
| 4,174,913 | A | 11/1979 | Schliesser | |
| 4,227,266 | A | 10/1980 | Russell | |
| 4,231,412 | A | 11/1980 | Nowak | |
| 4,290,635 | A | 9/1981 | McKenzie | |
| 4,349,296 | A | 9/1982 | Langeman | |
| 4,378,043 | A | 3/1983 | Sorenson | |
| 4,549,837 | A | 10/1985 | Hebert | |
| 4,576,512 | A | 3/1986 | Combes et al. | |
| 4,606,672 | A | 8/1986 | LeSire | |
| 4,669,371 | A | 6/1987 | Sarazen, Jr. et al. | |
| 4,676,145 | A | 6/1987 | Allred | |
| 4,699,045 | A | 10/1987 | Hensley | |
| 4,754,696 | A | 7/1988 | Sarazen et al. | |
| 5,171,102 | A | 12/1992 | De Wit | |
| 5,253,804 | A | 10/1993 | Sarazen et al. | |
| 5,293,820 | A | 3/1994 | Maejima et al. | |
| 5,294,049 | A | 3/1994 | Trunkle et al. | |
| 5,330,386 | A | 7/1994 | Calandra | |
| 5,408,789 | A | 4/1995 | Plfeger | |
| 5,460,572 | A | 10/1995 | Waltz et al. | |
| 5,487,701 | A | 1/1996 | Schedegger et al. | |
| 5,904,199 | A | 5/1999 | Messner | |
| 5,944,445 | A * | 8/1999 | Montgomery | E04B 1/7076 405/87 |
| 5,994,445 | A | 11/1999 | Kaschel et al. | |
| 6,063,632 | A | 5/2000 | Perkins | |
| 6,092,580 | A | 7/2000 | Lucas | |
| 6,287,050 | B1 | 9/2001 | Montgomery et al. | |
| 6,485,231 | B2 | 11/2002 | Montgomery et al. | |
| 6,692,187 | B2 * | 2/2004 | Sprengle, Sr. | E02B 7/40 405/92 |
| 2012/0028564 | A1 | 2/2012 | Kelly | |
| 2012/0067574 | A1 | 3/2012 | Lopez | |
| 2012/0266975 | A1 | 10/2012 | Kelly | |
| 2012/0325341 | A1 | 12/2012 | Kelly | |
| 2014/0109993 | A1 | 4/2014 | Kelly | |

FOREIGN PATENT DOCUMENTS

| | | |
|---|---|---|
| EP | 2290188 | 3/2011 |
| EP | 2365134 | 9/2011 |
| EP | 2374981 | 10/2011 |
| EP | 2458092 | 5/2012 |
| EP | 2764192 | 4/2013 |
| EP | 2634328 | 9/2013 |
| EP | 2647888 | 10/2013 |
| EP | 2662512 | 11/2013 |
| EP | 2682687 | 1/2014 |
| GB | 2147933 | 5/1985 |
| GB | 2397592 | 7/2004 |
| GB | 2461754 | 1/2010 |
| GB | 2466302 | 6/2010 |
| GB | 2498330 | 7/2013 |
| JP | 55-085720 | 6/1980 |
| JP | 04-203112 | 7/1992 |

OTHER PUBLICATIONS

Response to Office Action filed in U.S. Appl. No. 14/681,213, dated May 11, 2016.
Interview Summary mailed in U.S. Appl. No. 14/681,213, dated May 20, 2016.
Smart Vent, web pages from www.smartvent.com, printed Apr. 6, 2015.
Smart Vent, product literature "Smart Vent Foundation Flood Vents vs. Flood Flaps" printed Apr. 6, 2015.
Smart Vent, product literature "Family of Products" printed Apr. 6, 2015.
Fema, Openings in Foundation Walls and Walls of Enclosures, Technical Bulletin 1, Aug. 2008.
Fema, Non-Residential Floodproofing, Technical Bulletin 3, Apr. 1993.
Smart Vent, "Foundation Flood Vents" printed Apr. 6, 2015.
Smart Vent, Product Catalog printed Apr. 6, 2015.

* cited by examiner

FLOOD VENT TRIGGER SYSTEMS

TECHNOLOGY

The present application generally relates to flood water control devices for enclosed areas, and more particularly, to flood water control devices for venting enclosed spaces within a foundation, garage, foyer, an entry, basement or other such area.

BACKGROUND

To help limit flooding damage, several building code organizations and the federal government have promulgated regulations that mandate that buildings with enclosed spaces located below base flood plain levels, such as crawl spaces, must provide for automatic equalization of interior and exterior hydrostatic forces caused by flooding fluids. According to these regulations, flooding fluids must be permitted to freely enter and exit the enclosed spaces. In particular, many of these regulations require builders to install a number of vents in the enclosed spaces.

In addition to the regulations mentioned above, good construction practice embraces the use of vents which can be opened during warmer months to allow for ventilation to permit moisture to escape from crawl spaces, while retaining the ability to close during colder months to prevent the circulation of cold air around exposed plumbing in crawl spaces. Typically, the use of screening and louvers is necessary to achieve both the warm weather and cold weather requirements of proper venting and is required by at least some building codes for openings in foundation walls. As a result, a flood vent must be able to automatically remove the louver and screen barrier when confronted with free-flowing, flooding fluids.

SUMMARY

In one aspect, a flood vent comprises a door that is pivotable within a frame between a closed position and an open position and a fluid trigger that is triggerable by a fluid to allow the door to pivot from the closed position to the open position. In one embodiment, the fluid trigger comprises a retainer and a fluid modifiable material. The fluid modifiable material may be positioned between the door and the retainer thereby obstructing the door from pivoting from the closed position to the open position until the fluid modifiable material is modified by the fluid.

In one embodiment, the fluid modifiable material may comprise a water soluble composition configured to dissolve when contacted with flood waters. The retainer and fluid modifiable material may both be positioned on a same side of the door corresponding to the direction of pivoting of the door from the closed position to the open position. The door may be configured to automatically pivot from the closed position to the open position when the fluid modifiable material is modified by the fluid. In one configuration, the door is biased to pivot from the closed position to the open position by a spring such that the door automatically pivots from the closed position to the open position when the fluid modifiable material is modified by the fluid.

In one embodiment, the fluid trigger may comprise a trigger regulator. The trigger regulator may be configured to regulate a level of the fluid required before the fluid contacts the fluid modifiable material to modify the fluid modifiable material. The trigger regulator may comprise the retainer and the retainer may extend from a lower wall of the frame to a position corresponding to the level of the fluid required before the fluid contacts the fluid modifiable material to modify the fluid modifiable material. In one embodiment, the trigger regulator comprises a passage defined in the door configured to regulate a level of the fluid required before the fluid contacts the fluid modifiable material to modify the fluid modifiable material. In another embodiment, the trigger regulator comprises a passage defined in the door and extending between a first side and a second side of the door, and the fluid modifiable material is positioned adjacent to the first side of the door such that passage regulates access to the fluid modifiable material by fluid at the second side of the door. In a further embodiment, the fluid modifiable material is positioned to seal the first side of the door from the second side of the door when the fluid modifiable material is unmodified by the fluid. The trigger regulator may further comprise a rain guard positioned on the door above the passage, and the rain guard may be dimensioned to direct rain water away from the passage.

In another aspect, a flood vent comprises a door that is pivotable within a frame between a closed position and an open position and a fluid trigger that is triggerable to allow the door to pivot from the closed position to the open position. The fluid trigger may comprise a fluid modifiable material positioned to obstruct the door from pivoting from the closed position to the open position.

In one embodiment, the door is compressed against the fluid modifiable material when the door is in the closed position. The fluid modifiable material comprises a material configured to modify upon contact with water. Modification of the fluid modifiable material upon contact with water may comprise dissolution of the fluid modifiable material. The vent may further comprise a spring coupled to the door. The spring may be configured to pull the door from the closed position to the open position upon fluid modification of the fluid modifiable material.

BRIEF DESCRIPTION OF THE DRAWINGS

Presently preferred and alternative embodiments of the inventive arrangements are shown in the drawings, it being understood, however, the inventive arrangements are not limited to the precise arrangements and instrumentalities shown.

DESCRIPTION

Figure 1:
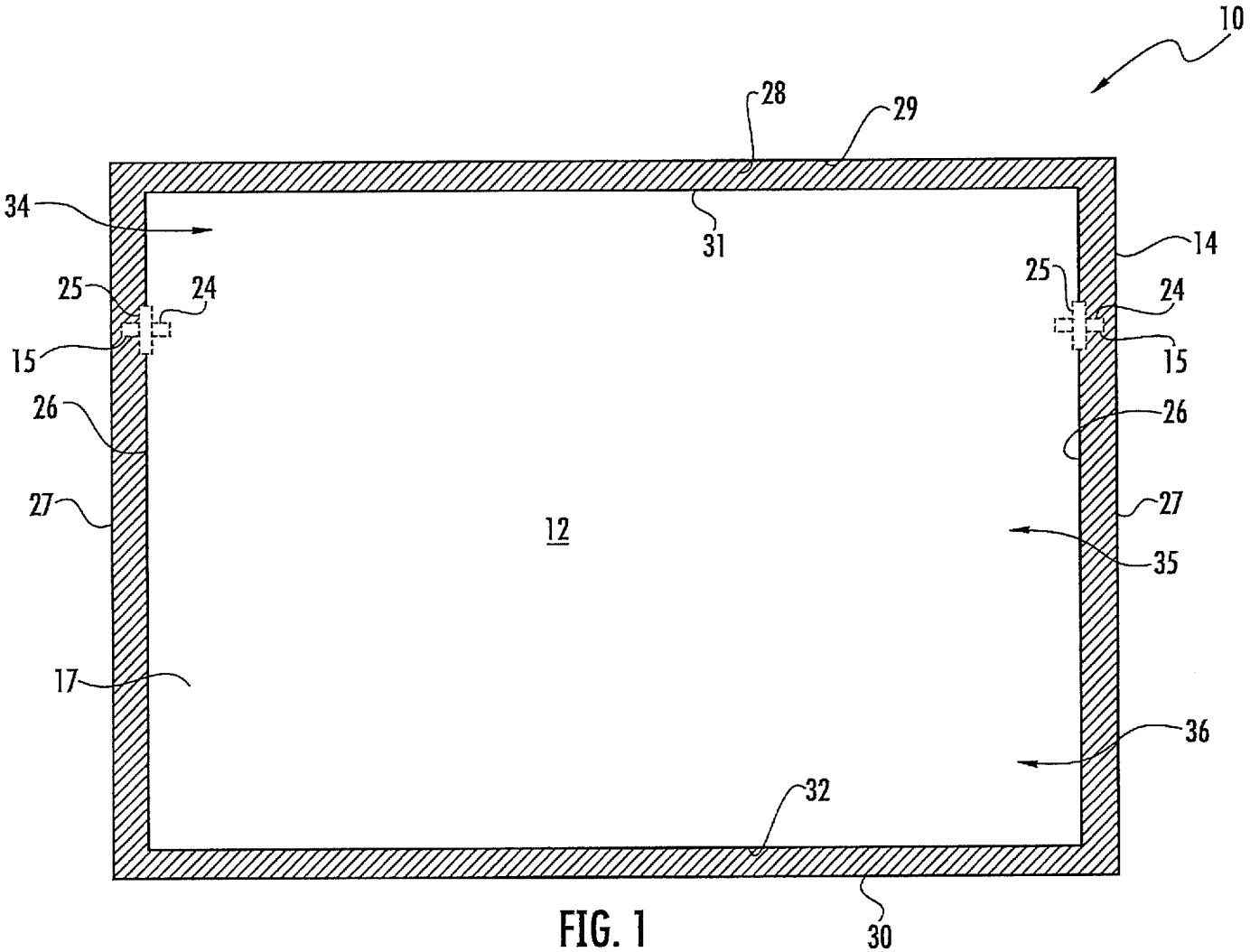
FIG. 1 illustrates a vent door positioned within a frame or duct according to various embodiments.
Figure 2:
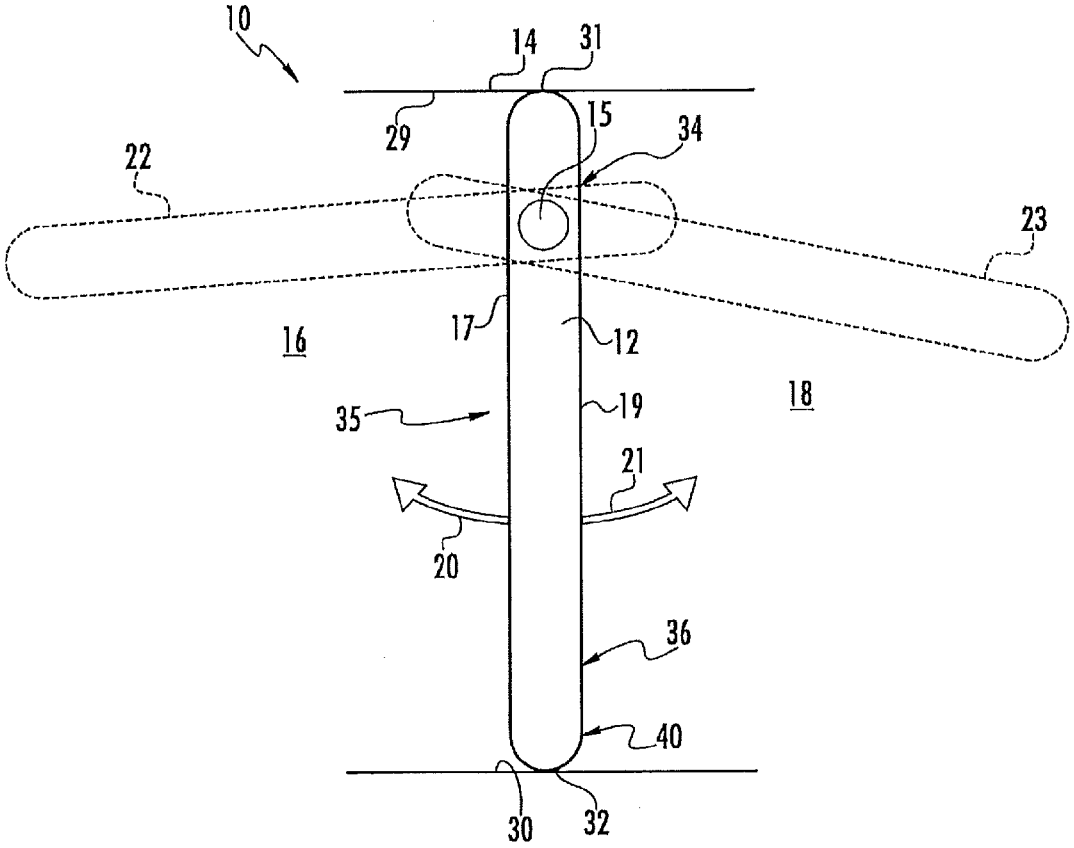
FIG. 2 illustrates a cross-sectional view of a vent comprising a door positioned within a frame or duct according to various embodiments.

FIGS. 1 and 2 illustrate general features of a vent 10 according to various embodiments. The vent 10 may include a door 12 configured to be positioned within a frame 14, a front view of which is show in FIG. 1 and a cross-sectional view is shown in FIG. 2. According to the various embodiments, the door 12 may comprise a separation device configured to separate a first environment located at a first side 16 of the door 12 and a second environment located at a second side 18 of the door 12 when the door 12 is in a closed position, as show in FIGS. 1 and 2. It will be appreciated that in operation the first or second environment may include an interior portion of the frame 14 or duct or an exterior environment thereto. For example, the door 12 may be positioned within the frame 14 such that the door 12 separates an interior portion of the duct at the first side 16 of the door 12 adjacent to a first face 17 of the door 12 and an external environment to the duct at the second side 18 of the door 12 adjacent to a second face 19 of the door 12. The external environment to the duct may include an interior of a building, foundation, or other structure, such as an enclosed area such as a room, crawl space, or enclosed portion of a foundation. The external environment may also include the exterior to the building, foundation, or other structure, which may be prone to flooding. Thus, the door 12 may be positioned within a duct that extends between an interior and exterior of a wall of a structure. Depending on the desired application, the door 12 may also be positioned at the exterior or interior opening of the duct, e.g., at a first or second end of the duct 13. For brevity, the portion of the duct interfacing with the door 12 in the closed position may be referred to as the frame 14, however, the frame 14 may be integral to the duct or may be configured to be fixed within the duct or at an opening of the duct.

In various embodiments, the door 12 may comprise a corrosion-resistant material, such as stainless steel, plastic, or polymer. The frame 14 may comprise or be locatable along a duct, e.g., within or at an opening of the duct, which may also be formed of a rigid corrosion resistant material, such as stainless steel, a plastic, or polymer. The frame 14 or duct is not limited as to a particular dimensioning; however, in one arrangement, the door 12 may be positioned within an 8 inch by 16 inch frame 14. Various door configurations are described in U.S. Pat. No. 6,287,050, issued Sep. 11, 2001 to Montgomery et al. for FOUNDATION FLOOD GATE WITH VENTILATION, and U.S. Pat. No. 6,692,187, issued Feb. 17, 2004 to Sprengle, Sr., et al. for FLOOD GATE FOR DOOR, the disclosures of which are incorporated herein in their entirety.

The door 12 may be attached to the frame 14 such that the door 12 may pivot relative to the frame 14 from the closed position in one or both of a first direction 20 and a second direction 21. For example, the door may pivot in a first direction 20 between the closed position and a first open position 22, see FIG. 2, shown in ghost, or in the second direction 22 between the closed position and a second open position 23, see FIG. 2, also shown in ghost. It will be appreciated that in various embodiments the first and second open positions 22, 23 may include greater or lesser pivots in the first and second directions 20, 21. Many features capable of pivoting the door 12 relative to the frame 14 are well known in the art, and all such features may be acceptable. However, as shown the door 12 may be configured to pivot about a pivot 15 that may pivotably couple the door 12 to the frame 14 via pins 24 pivotably received within slots 25. The pins 24 may extend between side faces 26 of the door 12 and side walls 27 of the frame 14. In one embodiment, the pins 24 may be attached to the side faces 26 of the door 12 and be adapted to be received within slots 25 defined in the frame 14. In another embodiment, the pins 24 may be attached to the frame 14 along the side walls 27 and be adapted to be received within slots 25 defined in the side faces 26 of the door 12.

The cross-sectional views of the various vent 10 embodiments described herein indicate positions wherein the door 12 may pivot as identified as pivot 15. However, other pivot positions 15 may be used. As shown, the pivot 15 is positioned along an upper portion 34 of the door 12, however, in other embodiments, the pivot 15 may be located along a middle 35 or lower portion 36 of the door 12. The door 12 may also comprise one or more louvers or multiple stacked doors 12 configured to rotate independently or together about the pivots 15. Thus, the door 12 may be configured to open in one or both directions 20, 21. For example, the pivot 15 may include a stopper configured to prevent pivoting of the door 12 in the first direction 20 or second direction 21 or an extent thereof. For example, the stopper may include an engagement surface or notch positioned or defined on the pin 24 or pivot 15 configured to engage another stopper comprising an engagement surface to prevent the door 12 from pivoting beyond at predetermined position between the closed position and an open position. The pivot 15 may also be biased to limit or assist pivot movements of the door 12 in the first or second directions 20, 21 or between open and closed positions.

In another embodiment, not shown, the pivot 15 includes a pin, which may be similar to pin 24, coupled to the door 12 and a rail or groove defined along the duct wall, e.g., along the frame 14, along which the door 12 may slide. The groove may extend arcuately in the first or second directions 20, 21 such that pressure or force, e.g., due to accumulation of fluid at the first or second side 16, 18 causes the door 12 to slide laterally and upward or downward such that a first or second face 17, 19 of the door 12 is positioned adjacent the upper or lower wall 29, 30 of the frame 14. In a further configuration, the groove may be stepped such that the door 12 may move from a first position along the groove in either the first direction 20 or second direction 21 until the door 12 reaches a second position or a one-way step, e.g., in the first direction 20, at which point the door 12 may be prevented by the groove from a returning movement in the second direction 21, toward the first position. Additional movements of the door 12 in the first direction 20 to further one-way steps may similarly prevent the door 12 from returning to previous positions in the second direction 21. In another embodiment, the groove may extend laterally through the duct and include an open end such that movement of the door 12 in the first or second direction 20, 21 causes the pin to exit the groove through the open end thereby removing the by the door 12 from the duct.

As shown in FIG. 1, a liner 28 may be positioned between or along the interfacing portions of the door 12 and frame 14 to provide additional insulation or a seal. The liner 28 may be positioned along the upper 29, lower 30, or side walls 27 of the frame or upper 31, lower 32, or side faces 26 of the door 12, or both and may include insulation materials or materials dimensioned to seal the interfaces such as rubber, plastics, foam, polymeric, or insulative materials, etc. In one embodiment, the liner 28 comprises a rubber flap configured to engage the adjacent surface of the interface to provide an improved seal between the first and second sides 16, 17 of the door 12. In one embodiment, the liner 28 may extend between the frame 14 and the or upper 31, lower 32, or side faces 26 of the door 12 such that the first or second face 17, 18 of the door may rest against the liner 28. For example, the vent 10 may be configured such that the first or second face 17, 18 of the door 12 is compressed against the liner 28 when the door 12 is in the closed position.

Vents 10 may be installed in various configurations. For example, vents 10 may be installed independently, or in a stacked, modular formation within a structure or wall forming a portion of a house or other structure or in an overhead garage door, for example. Such multi-vent formations may be desirable in flood prone areas where the number of vents 10 required for proper ventilation would make the foundation structurally unsound if the vents 10 were placed side by side. Multi-vent configurations may also be desirable when a foundation is not formed from concrete block but rather formed from poured concrete where it may be more desirable to make holes of larger size but fewer in number than numerous openings having small sizes. In this configuration, each vent 10 may or may not act independently of each other. For example, in at least one embodiment, opening of a single vent 10 may similarly trigger the opening of additional vents 10. That is, a vent 10 may be triggered as described herein by fluid resulting in opening of the door 12, which in some embodiments may similarly result in the opening or the ability to open doors 12 associated with one or more additional vents 10. In at least one embodiment, the vent 10 includes a kit configured for retrofitting ducts and comprises a door 12 and frame 14 in which the door 12 is positioned. The frame 14 may be configured to be positioned within the duct or at an opening and secured thereto.

As introduced above, in various embodiments, a vent 10 may comprise a fluid trigger 40. Fluid triggers 40 may be configured such that the opening or ability to open the door 12 from the closed position in the first or second direction 20, 21 is triggered by the presence or action of fluid, e.g., force applied to the door 12 due to the pressure or accumulation of flood waters, as generally shown in FIG. 2, chemical reaction, surface reactions, hydrolysis, volume intake, osmosis, diffusion, or disruption or modulation of an electrical current or field, etc.

Figure 3:
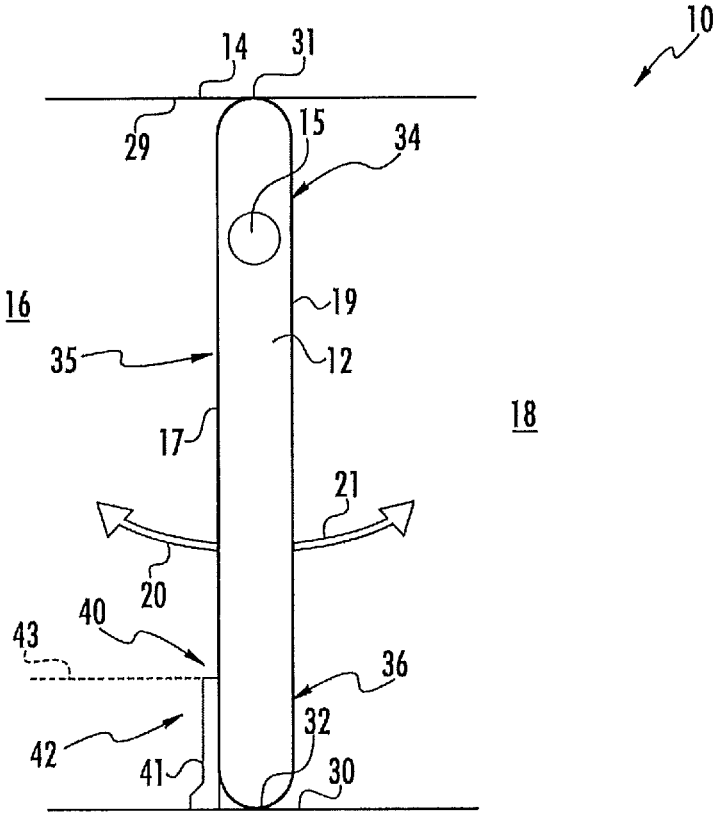
FIG. 3 illustrates a cross-sectional view of a vent comprising a retainer according to various embodiments.

FIG. 3 illustrates a cross-sectional view of an embodiments of a vent 10 comprising a fluid trigger 40 wherein a retainer 41 is positioned to at least partially retain the door 12, e.g., limit movements or pivoting of the door 12 in the first or second direction 20, 21, either alone or in cooperation with another component of the fluid trigger 40. As shown, the retainer 41 is positioned to prevent 10 the door 12 from moving, e.g., pivoting, in the first direction 20 in response to a force applied in that direction.

The vent 10 illustrated in FIG. 3 also includes a trigger regulator 42. Trigger regulators 42 may be configured to regulate the conditions in which fluid may trigger opening or the ability of the door 12 to open. For example, trigger regulators 42 may control or modify fluid access to fluid trigger 40 elements. In the illustrated embodiment, the trigger regulator 42 includes the retainer 41 that extends from the lower wall to position 43 comprising a flood level dimensioned to limit fluid access to door 12 at fluid accumulations below position 43. For example, fluid may be allowed to accumulate along the lower wall 30 without applying pressure or force to the first face 17 of the door 12. Thus, flood waters are not available to apply force to open the door 12 in the second direction 21 unless the accumulation is above position 43 and applies force against the first face 17 sufficient to move the door 12 from the closed position in the second direction 21.

Figure 4:
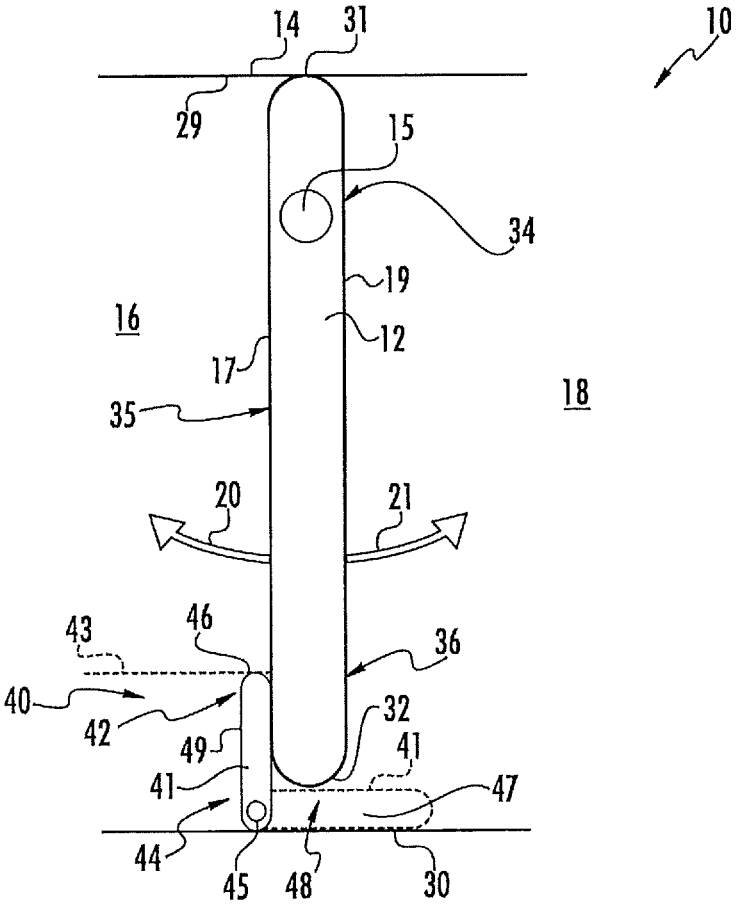
FIG. 4 illustrates a cross-sectional view of a vent comprising a pivotable retainer according to various embodiments.

FIG. 4 illustrates a cross-sectional view of one embodiment of a vent 10 comprising a conditioning component 44. Conditioning components 44 may comprise selectively modifiable retainers 41 wherein the retention aspects of the retainer 41 may be selectively removed or modified by a user. Conditioning components 44 may also comprise retainer 41 configurations that are modifiable due to an action of the fluid. The vent 10 shown in FIG. 4 may otherwise be similar to the vent 10 described with respect to FIG. 3. The conditioning component 44 comprises a pivot or hinge 45 that allows the retainer 41 to pivot from the first retaining position 46 to a second release position 47, shown in ghost, against the lower wall 30. The door 12 may also be dimensioned to extend between the upper wall 29 and lower wall 30 of the frame 14 such that a gap 48 is positioned between the lower face 32 of the door 12 and the lower wall 30 of the frame 14 sufficient to allow the door 12 to move in the first direction 20 when the retainer 41 is in the second position 47. Thus when the door 12 is sufficiently pivoted in the second direction 21, the retainer 41 may pivot to the second position 47, at which time the door 12 may be subsequently pivoted to open positions in either the first direction 20 or second direction 21. For example, when the fluid trigger 40 is triggered by the action of fluid and the door 12 is moved from the closed position in the second direction 21 to an open position, flood waters may flow from the first side 16 to the second side 18. Such flow may result in the movement of the retainer 41 from the first position 46 to the second position 47 and thereafter allow the door 12 to return to the closed position and subsequently open in the first direction 20, e.g., to provide a path for the flood waters to pass or recede from the second side 18 to the first side 16. Similarly, prior to a flood or threat of a flood, the retainer 41 may be pivoted to the second position 47 to limit its obstruction to movement of the door 12 in either the first direction 20 or second direction 21. In one such embodiment, a face 49 of the retainer 41 positioned toward the lower face 32 of the door 12 or adjacent thereto may include a seal. The seal may include a compressible material or one or more ridges into which the lower face of the door 12 or a flap or wiper may extend against or between to provide a loose seal. The loose seal may be sufficient to limit air circulation between the first and second sides 16, 18 but configured to give way to a flow of flood water to allow the door 12 to open in the first direction 20 or the second direction 21 upon application of a sufficient predetermined force on the door 12 in the corresponding first direction 20 or second direction 21. The movement of the retainer 41 to the second position 47 may be initially limited. For example, as described below, a fluid modifiable adhesive, such as a water soluble adhesive, may be used to retain the retainer 41 in the first position 46. The adhesive may be applied between the interface of the retainer 41 and the first face 17 of the door 12 or along the retainer 41 or hinge 45 to retain the retainer 41 in the first position 46 until the adhesive action of the adhesive is sufficiently deteriorated by flood waters.

Figure 5:
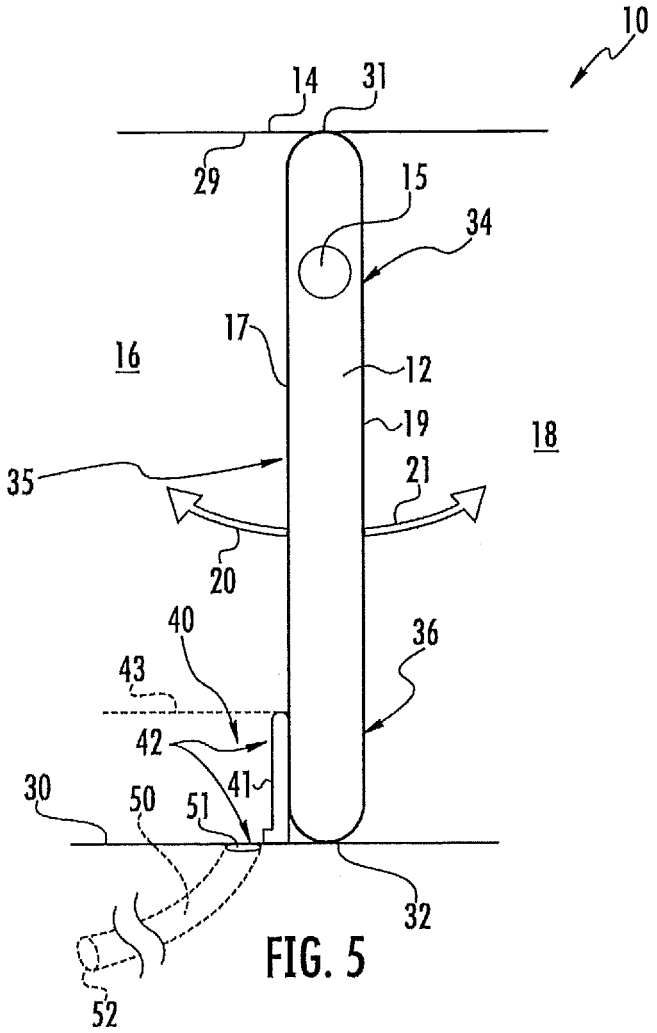
FIG. 5 illustrates a cross-sectional view of a vent configured with a fluid trigger comprising a retainer and a trigger regulator comprising one or more drains according to various embodiments.

In various embodiments, trigger regulators 42 may be configured to direct or redirect fluid. FIG. 5 illustrates an embodiment of a vent 10 comprising a fluid trigger 40. The fluid trigger 40 comprises a trigger regulator 42 comprising one or more drains 50 defined in the lower wall 30. The one or more drains 50 may be arranged and sized to control a flow of fluid at the first side 16 through a first port 51 and to direct the fluid away from the retainer 41 or door 12 toward a second port 52. The one or more drains 50 may control the rate in which fluid must accumulate at the first side 16 in order to reach position 43 and apply force at the first face 17 of the door 12 to open the door 12 in the second direction 21. For example, such a configuration may be beneficial when the first side 16 is partially enclosed or exposed to water that may be susceptible to accumulation absent flood conditions. Such drains 50 may also be beneficial when it is desirable to have smaller retainers 41 or shallower flood levels. Other trigger regulators 42 configured to direct fluid away from the door 12 may include lower walls 30 having declined surfaces or fluid directing grooves configured to direct fluid away from the door 12 or components of the fluid trigger 40.

Figure 6:
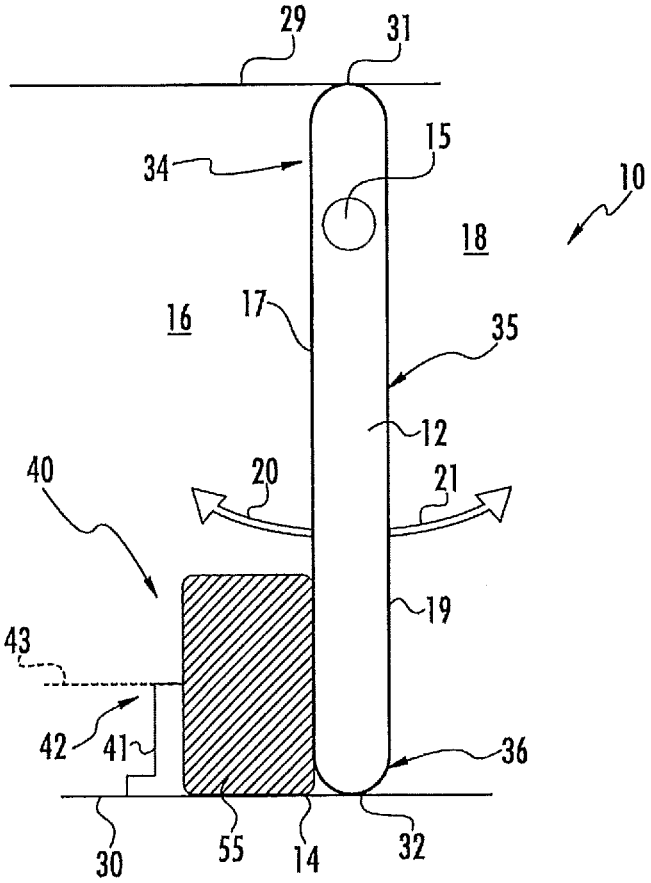
FIG. 6 illustrates a cross-sectional view of a vent configured with a fluid trigger comprising a retainer and a fluid modifiable material according to various embodiments.

FIG. 6 illustrates a cross-sectional view of another embodiment of a vent 10 comprising a fluid trigger 40. The components of the fluid trigger 40 comprise a retainer 41 and a fluid modifiable material 55 positioned to prevent the door 12 from moving to an open position in the first direction 20. Depending on the configuration, the door 12 may be prevented from moving to an open position in the second direction 21 at the pivot 15 or the fluid modifiable material 55 may be adhered to the first face 17 of the door 12 at a fluid modifiable layer or with a fluid modifiable adhesive, as described below. In operation, upon removal of the fluid modifiable material 55 the door 12 is configured to be moved to an open position in the first direction 20.

In another embodiment, the fluid modifiable material 55 is configured to expand to open the door 12 in the second direction 21, after which time the flow of fluid may disperse or dislodge the fluid modifiable material 55. In at least one embodiment, expansion of the fluid modifiable material 55 is configured to pivot the lower portion 36 of the door 12 in the second direction 21 to open the door 12 along an upper portion 34 in the first direction 20.

According to various embodiments, the fluid modifiable material 55 may generally be configured to at least partially modify in state, size, shape, or consistency due to the action of the fluid and may include various swellable or dissolvable materials including gels, foams, polymers, compacts, or compressed compositions. In various embodiments, the fluid modifiable material 55 may comprise a pellet or strip of modifiable material 55 that may be positioned or applied, e.g., as a paste or viscous composition, between the door 12 and the retainer 41. The fluid modifiable material 55 may be positioned to operate as a temporary seal or insulation prior to modification by fluid. For example, in at least one embodiment, the fluid modifiable material 55 is configured to insulate or seal the passage 58 while unmodified by the fluid in addition to providing an obstruction to the opening of the door 12.

In some embodiments, the fluid modifiable material 55 comprises other materials configured to at least partially dissolve or breakdown upon exposure to water or other fluid action. For example, in one embodiment, the fluid modifiable material 55 comprises a water soluble mass such as compressed salt or sugar. In another example, the fluid modifiable material 55 may comprise a composition of corn starch and a polyvinyl.

In some embodiments, the retainer 41 also comprises a fluid modifiable material 55. In at least one embodiment, the retainer 41 or a fluid modifiable material 55 or a layer thereof is positioned to retain the door 12 in the closed position and is adhered to the door 12 or lower wall 30 by a fluid dissolvable or deactivatable adhesive, e.g., a water soluble adhesive, such that when exposed to flood waters the adhesive breaks down or releases the retainer 41 or fluid modifiable material 55 to allow the door 12 to receive the action of the fluid or other fluid trigger 40 component configured to act upon removal of the obstruction, for example a bias configured to open the door 12 in the first or second direction 20, 21 or a retractor configured to retract the retainer, fluid modifiable material 55, or portion thereof upon action of the fluid to modify the fluid modifiable material 55.

Figure 7:
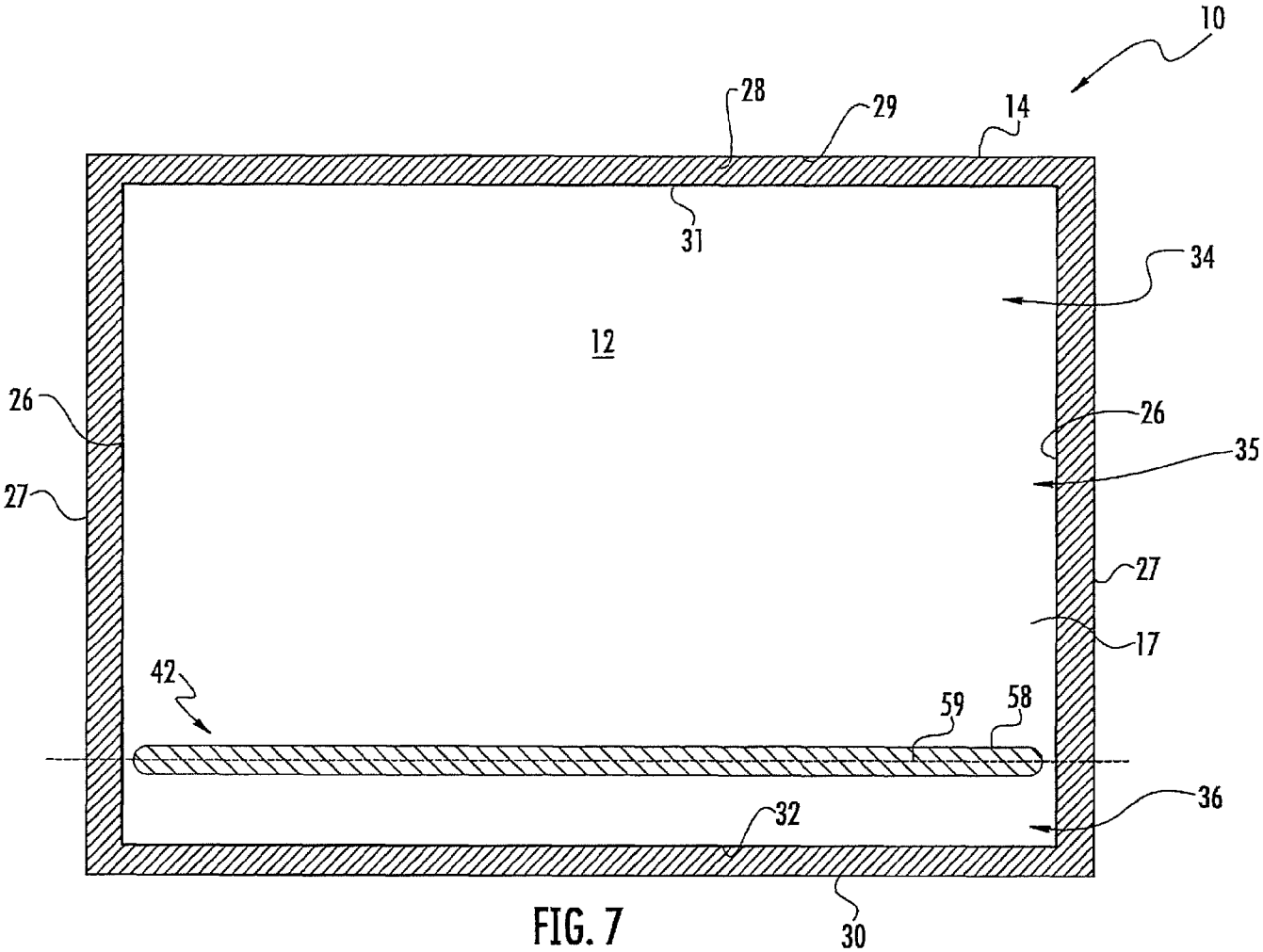
FIG. 7 illustrates a front view of a door comprising a passage according to various embodiments.

In various embodiments, the door 12 may be configured to incorporate one or more components of the fluid trigger 40. For example, FIG. 7 illustrates a vent 10 wherein the door 12 is positioned within a frame 14. The door 12 defines a passage 58 extending between the first and second sides 16, 18 of the door 12. The door 12 may optionally include a mesh grill 59 disposed within or at one or more entrances of the passage 58. Although the mesh grill 59 may allow air to pass between the first and second sides 16, 18 of the door 12, the size of the openings in the grill 59 may be sufficiently small to prevent 10 objects such as small animals, as required by model building codes for openings in foundation walls, from passing through the door 12.

Figure 8:
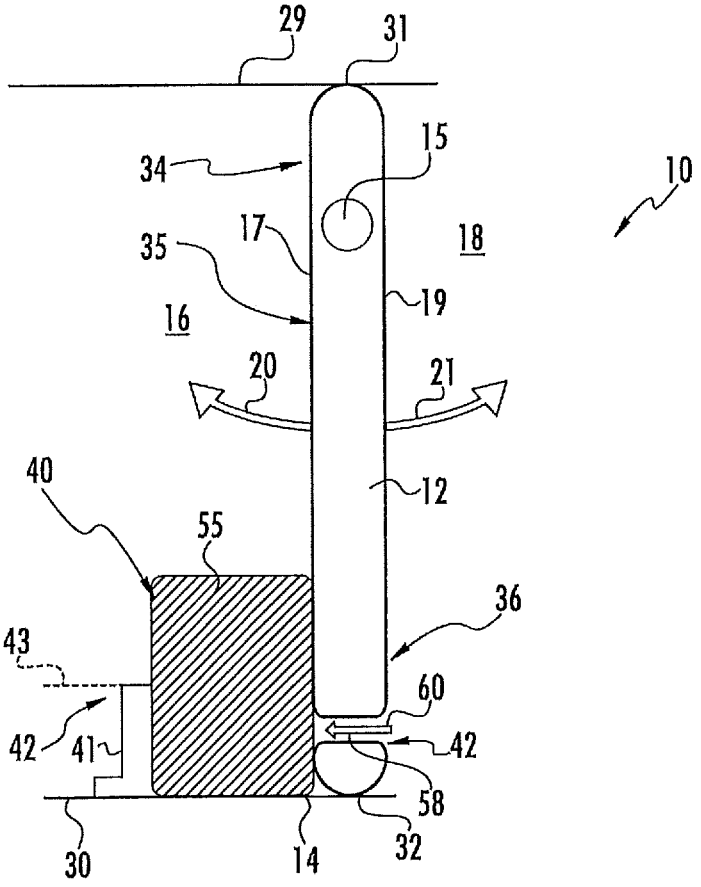
FIG. 8 illustrates a cross-sectional view of a vent configured with a fluid trigger comprising a retainer, a fluid modifiable material, and a passage defined in the vent door according to various embodiments.

FIG. 8 illustrates an embodiment of vent 10 wherein the fluid trigger 40 includes a door 12 defining a passage 58 between the first and second sides 16, 18 of the door 12. The passage 58 may be configured as a trigger regulator 42 to allow fluid to pass as generally shown by arrow 60 from the second side 18 to expose the fluid modifiable material 55 to the fluid such that the action of the fluid may modify the material 55, e.g., dissolve the material 55, by the action of the fluid, as described above to allow the door 12 to be opened by force or pressure in the first direction 20 or the second direction 21, which may be applied via force resulting from the fluid or a fluid trigger 40 component, e.g., a biasing member configured to bias the door 12 toward an open position in the first or second direction 16, 18. The passage 58 may be positioned on the door 12 such that the passage 58 comprises a trigger regulator 42 to prevent 10 passage 58 of fluid through the passage 58 to modify the fluid modifiable material 55 until the fluid level reaches the lower extent of the passage 58.

Figure 9:
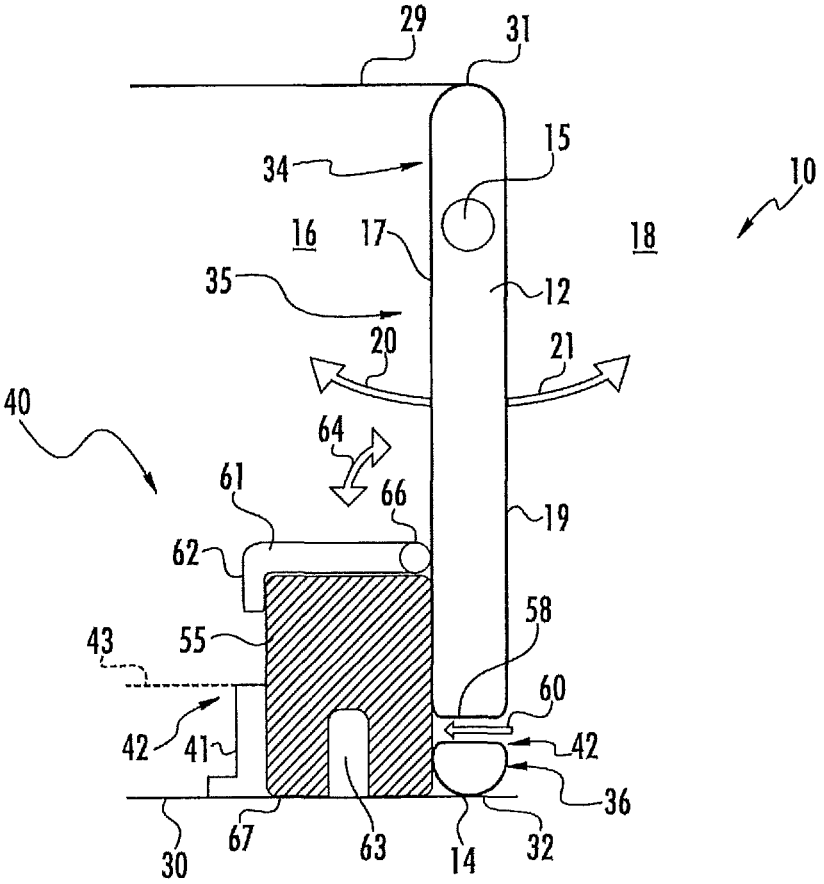
FIG. 9 illustrates a cross-sectional view of a vent configured with a fluid trigger of FIG. 8 and further comprising a cover having a cover lip and a retainer comprising a retainer lip according to various embodiments.

FIG. 9 illustrates a cross-sectional view of a further embodiment of the vent 10 illustrated in FIG. 8. In this embodiment, the fluid trigger 40 further includes conditioning components 44 comprising a cover 61 comprising a cover lip 62 and retainer 41 comprising a retainer lip 63, which may be integral or separate from the abutment portion of the retainer 41. The cover 61 may be configured to cover a portion of the fluid modifiable material 55. The cover 61 may be pivotable as indicated by arrows 64 about a pivot 65 to expose and enclose a pellet compartment 66 configured to retain the fluid modifiable material 55. The cover lip 62 may be configured to extend over an edge of the fluid modifiable material 55.

The retainer lip 63 may extend from the lower wall 30 within the compartment 66 and be configured to be received within a groove 67 defined in the fluid modifiable material 55. The cover 61, cover lip 62, or retainer lip 63 may be configured to stabilize the position of the fluid modifiable material 55 or the door 12 to provide an additional measure of security by limiting the movement of the door 12 in the second direction 21 when the fluid modifiable material 55 has not been modified by the fluid, e.g., after being exposed to fluid flow 60 through the passage 58. Thus, in such an embodiment, the door 12 may be configured to open in the first direction 16 and the second direction 18 after the fluid action has modified the fluid modifiable material 55.

Figure 10:
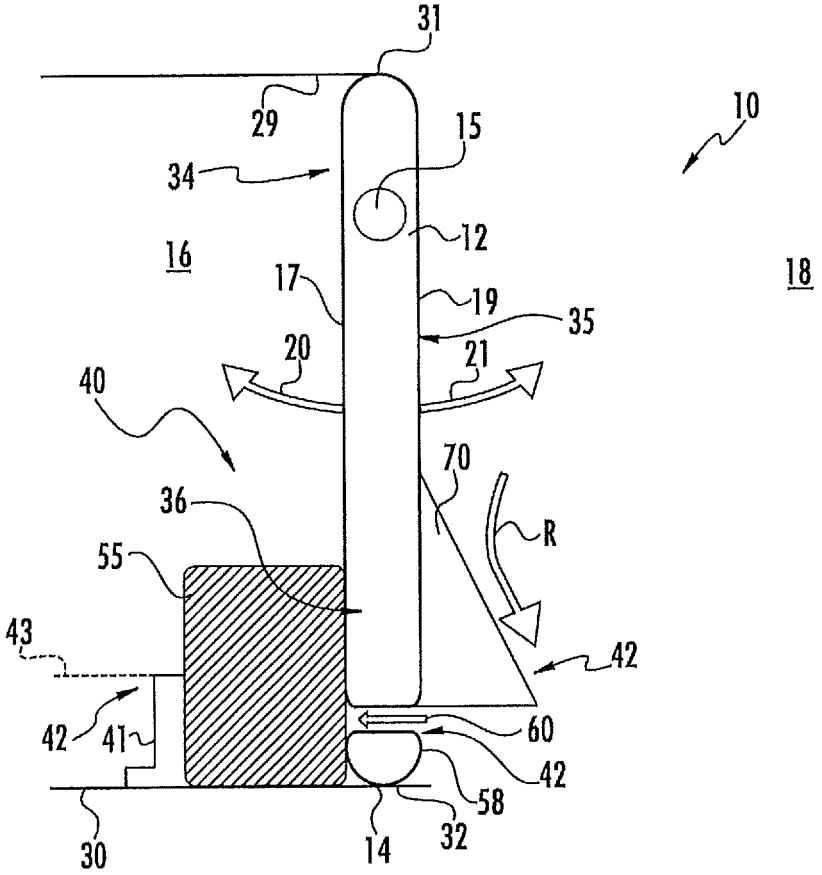
FIG. 10 illustrates a cross-sectional view of a vent configured with a fluid trigger of FIG. 8 and further comprising a rain guard according to various embodiments.

FIG. 10 illustrates a cross-sectional view of an embodiment of a vent 10 comprising a fluid trigger 40 wherein the fluid trigger comprises a retainer 41, a fluid modifiable material 55, passage 58, and a trigger regulator 42 comprising a rain guard 70. The rain guard 70 may be particularly beneficial in embodiments wherein, as shown, the second side 18 comprises an external environment exposed to rain. The rain guard 70 extends from the second face 19 of the door 12 above the passage 58. While various configurations may be used to redirect rain or otherwise prevent 10 rain from entering the passage 58, the illustrated rain guard 70 includes a declined surface extending away from the second face 19 of the door 12 to direct rain there along as generally shown by arrow R.

Figure 11:
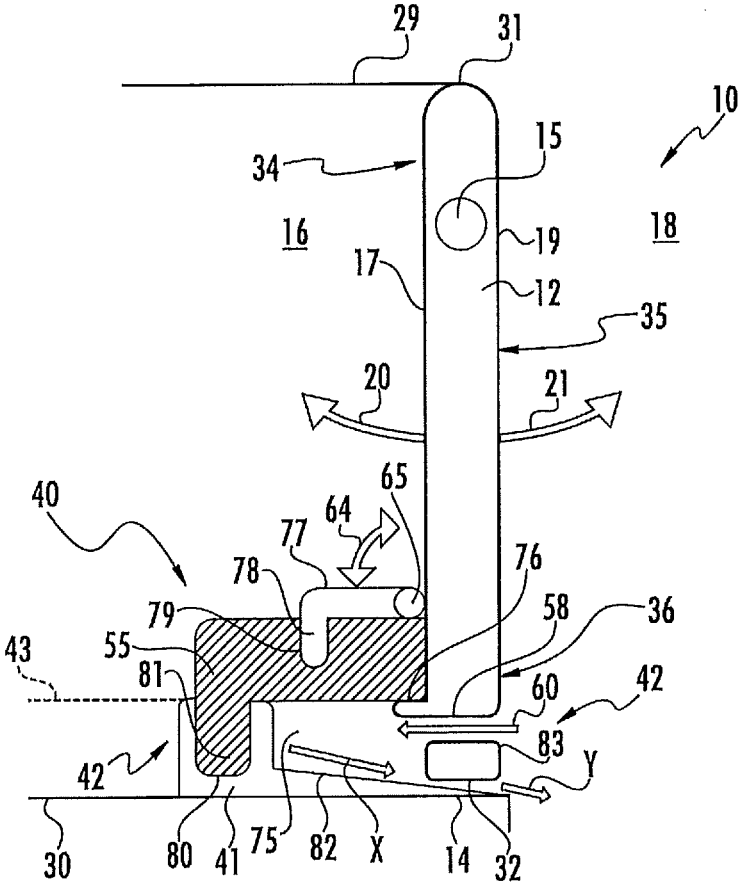
FIG. 11 illustrates a cross-sectional view of a vent comprising a fluid trigger including fluid accumulation chamber according to various embodiments.
Figure 12:
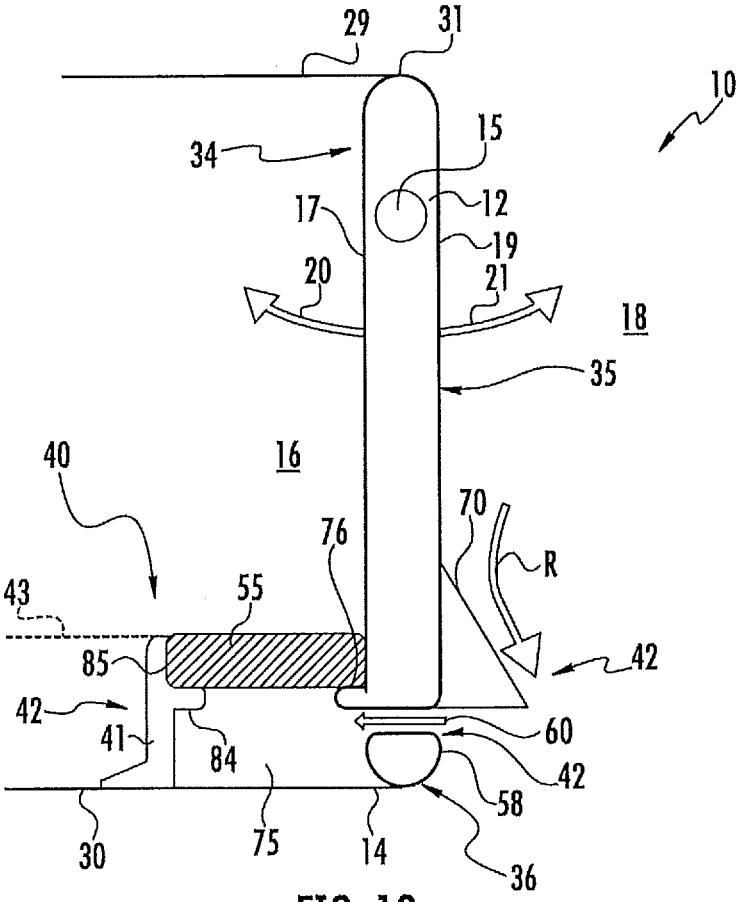
FIG. 12 illustrates a cross-sectional view of a vent comprising a fluid trigger including a fluid accumulation chamber according to various embodiments.

FIGS. 11 and 12 illustrate cross-sectional views of embodiments of vents 10 comprising fluid triggers 40 wherein the fluid triggers 40 include fluid accumulation chambers 75. The door 12 includes a lip 76 extending from the first face 17 of the door 12 configured to seat the fluid modifiable material 55. The door 12 of FIG. 11 also includes a latch 77 having a lip 78 configured to be received within a groove 79 of the fluid modifiable material 55. The latch 77 may be pivotable as indicated by arrow 65 about a pivot 64 to allow insertion and engagement of the latch 77 with respect to the fluid modifiable material 55. The retainer 41 comprises a groove 80 configured to receive a rail or lip 81 attached to or formed of fluid modifiable material 55. As describe above with respect to FIG. 9, the configuration of FIG. 11 may similarly provide additional security to secure the door 12 in the second direction 21 prior to modification of the fluid modifiable material 55 such that movement of the door 12 from the closed position in the second direction 21 is also conditional on the modification of the fluid modifiable material 55

The fluid trigger 40 of FIGS. 11 and 12 may also comprise a trigger regulator 42. As shown in FIG. 11, the trigger regulator 42 may comprise a rain guard 70, which may be similar to the rain guard 70 described above with respect to FIG. 10. In the embodiment shown in FIG. 11, the trigger regulator 42 comprises a surface 82 along the lower wall 30 of the fluid accumulation chamber 75 that is declined toward the first face 17 of the door 12 to direct fluid out of the fluid accumulation chamber 75, as depicted by arrows X and Y. The surface 82 may also comprise grooves configured to channel fluid away from the fluid accumulation chamber 75. The door 12 may include one or more fluid exit ports 83 defined in the lower portion 36 thereof. The lower face 32 of the door 12 may also extend toward the lower wall 30 such that an exit port 83 is defined between the lower face 32 of the door 12 and the lower wall 30. In this or another embodiment, the lower wall 30 of the fluid accumulation chamber 75 may also include one or more drains configured to drain fluid from the fluid accumulation chamber to one or more fluid exit ports. In these or other embodiments, a trigger regulator 42 may comprise a lip or retainer 41 dimension configured to limit the extent of a surface of the fluid modifiable material 55 that is exposed to fluid in the fluid accumulation chamber 75 or path of fluid.

The retainer 41 of FIG. 12 also includes a lip 84 extending toward the first face 17 of the door 12 configured to seat the fluid modifiable material 55 and an abutment surface 85 to prevent 10 movement of the fluid modifiable material 55 or door 12 in the first direction 20 prior to modification of the fluid modifiable material 55. As described above, the door 12 may be prevented from opening in the second direction 21, e.g., by the pivot 15, or may be biased in the first direction 20 by a component of the fluid trigger 40 such that the bias compresses the first face 17 of the door 12 against the fluid modifiable material 55 and abutment surface 85 when the fluid modifiable material 55 has not been modified.

Figure 13:
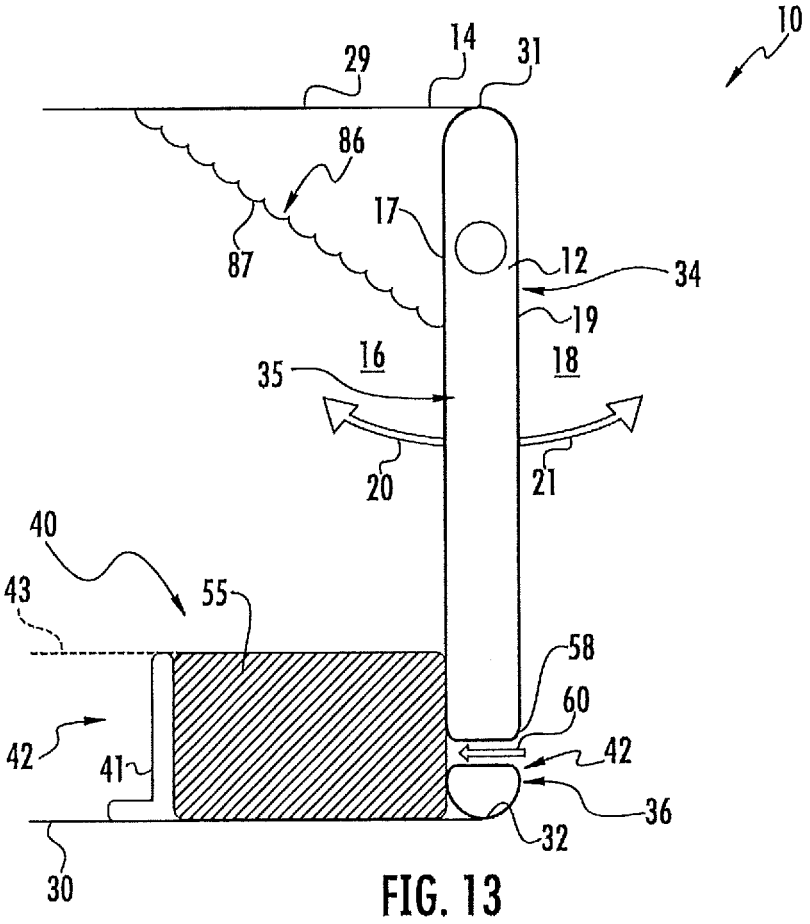
FIG. 13 illustrates a cross-sectional view of a vent comprising a fluid trigger including a biasing trigger element configured to automatically open the door upon removal of a fluid modifiable material obstruction according to various embodiments.

FIG. 13 illustrates a cross-sectional view of an embodiment of a vent 10 comprising a fluid trigger 40 comprising a biasing trigger component 86 configured to automatically open the door 12 upon removal of the obstruction presented by the fluid modifiable material 55. The biasing trigger component 86 may comprise a spring 87 or other biasing device configured to bias the opening of the door 12 in the first or second direction 20, 21. As shown, the fluid trigger 40 further comprises a retainer 41, a fluid modifiable material 55, and a door 12 defining a passage 58 as described above. The biasing trigger component 86 comprises a spring 87 attached to the first face 17 of the door 12 and the upper wall 29 of the duct or frame 14, however, other configurations may be used. For example, the spring 87 may be attached to a side wall 27. The spring 87 is configured to bias the door 12 toward an open position in the first direction 20. For example, when fluid passes through the passage 58 as indicated by arrow 60 to modify the fluid modifiable material 55, the spring 87 may pull the door 12 to an open position in the first direction 20 when the obstruction provided by the fluid modifiable material 55 is removed.

Figure 14:
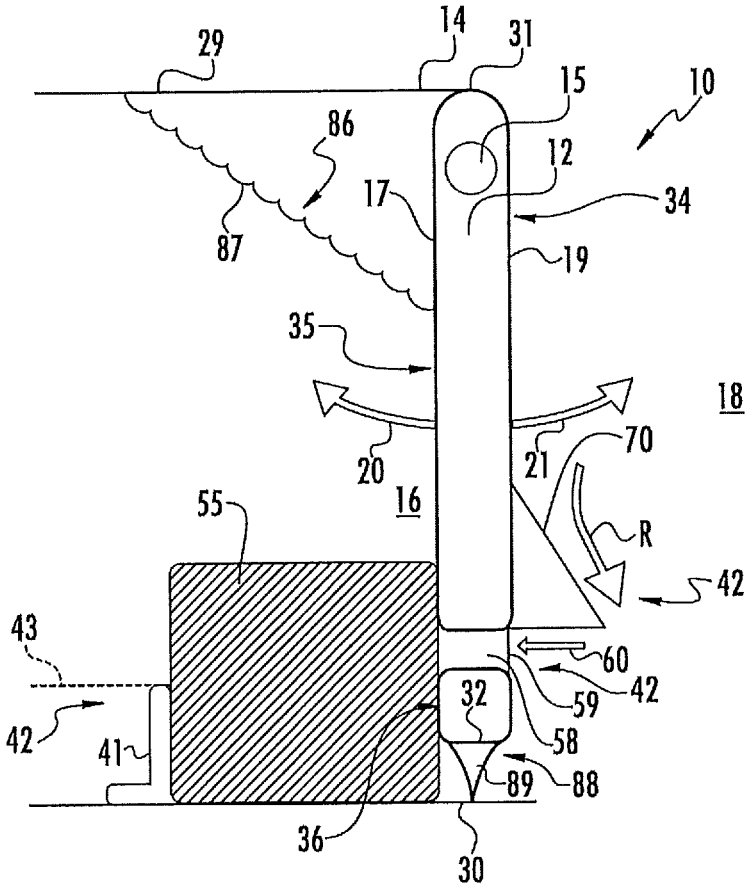
FIG. 14 illustrates a cross-sectional view of a vent comprising a fluid trigger including a biasing trigger element configured to automatically open the door upon removal of a fluid modifiable material obstruction according to various embodiments.

As introduced above, in various embodiments, the door 12 may comprise a seal positioned between the lower face 32 of the door 12 and the lower wall 30 when the door 12 is in the closed position. The seal may include a rubber, polymeric, or compressible material configured to provide a seal between the first and second sides 16, 18. FIG. 14 illustrates a cross-sectional view of an embodiment of a vent 10 comprising a fluid trigger 40 and a seal 88 including a rubber blade 89. The fluid trigger 40 includes a fluid regulator 42 comprising a retainer 41, a fluid modifiable material 55, a passage 58 defined in the door 12, and a rain guard 70 positioned on the second face 19 of the door 12 above the passage 58. A grill 59 is positioned at an opening of the passage 58. The retainer 41 and fluid modifiable material 55 are positioned to prevent 10 movement of the door 12 to an open position in the first direction 20. The fluid trigger 40 further comprises a biasing trigger component 86 formed of a spring 87 attached to the first face 17 of the door 12 and the upper wall 29 of the duct or frame 14. In operation, when fluid passes through the passage 58 as indicated by arrow 60 to modify the fluid modifiable material 55, the spring 87 pulls the door 12 to an open position in the first direction 20 when the obstruction provided by the fluid modifiable material 55 is removed.

This disclosure describes various elements, features, aspects, and advantages of various embodiments of the stopping systems, apparatuses, and methods thereof. It is to be understood that certain descriptions of the various embodiments have been simplified to illustrate only those elements, features and aspects that are relevant to a more clear understanding of the disclosed embodiments, while eliminating, for purposes of brevity or clarity, other elements, features and aspects. Any references to "various embodiments," "certain embodiments," "some embodiments," "one embodiment," or "an embodiment" generally means that a particular element, feature and/or aspect described in the embodiment is included in at least one embodiment. The phrases "in various embodiments," "in certain embodiments," "in some embodiments," "in one embodiment," or "in an embodiment" may not refer to the same embodiment" Furthermore, the phrases "in one such embodiment" or "in certain such embodiments," while generally referring to and elaborating upon a preceding embodiment, is not intended to suggest that the elements, features, and aspects of the embodiment introduced by the phrase are limited to the preceding embodiment; rather, the phrase is provided to assist the reader in understanding the various elements, features, and aspects disclosed herein and it is to be understood that those having ordinary skill in the art will recognize that such elements, features, and aspects presented in the introduced embodiment may be applied in combination with other various combinations and sub-combinations of the elements, features, and aspects presented in the disclosed embodiments. It is to be appreciated that persons having ordinary skill in the art, upon considering the descriptions herein, will recognize that various combinations or sub-combinations of the various embodiments and other elements, features, and aspects may be desirable in particular implementations or applications. However, because such other elements, features, and aspects may be readily ascertained by persons having ordinary skill in the art upon considering the description herein, and are not necessary for a complete understanding of the disclosed embodiments, a description of such elements, features, and aspects may not be provided. As such, it is to be understood that the description set forth herein is merely exemplary and illustrative of the disclosed embodiments and is not intended to limit the scope of the invention as defined solely by the claims.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise.

It will be further appreciated that for conciseness and clarity, spatial or relative terms such as "vertical," "horizontal," "upper," "lower," "lateral," "longitudinal," and others may be used herein with respect to the illustrated embodiments. However, vents 10 may be used in many orientations and positions, as such, these terms are not intended to be limiting and absolute. All numerical quantities stated herein are approximate unless stated otherwise, meaning that the term "about" may be inferred when not expressly stated. Additionally, in some illustrative embodiments, dimensions including a parameter, measurement, diversion, or range may be given. It is to be understood that any such parameter, measurement, diversion, or range is provided as an illustrative example or instance of an embodiment and is not intended to limit that or other embodiments. For example, unless otherwise specified, illustrations of dimensions and how such parameters or measurements of such dimensions relate to other parameters, e.g., with respect to movement, support, engagements, interfacing dimensions are provided to aid the reader's understanding of the features and may not be illustrated to scale nor universally applicable to every embodiment.

What is claimed is:

1. A flood vent, the vent comprising:

a door pivotable within a frame between a closed position and an open position;

a retainer pivotable between a first position and a second position, wherein, in the first position, a first face of the retainer is positioned against a first face of the door, and the retainer is configured to prevent the door from pivoting between the closed position and the open position in a first direction, wherein, in the second position, the first face of the retainer is positioned against the frame, and the retainer is configured to allow the door to pivot between the closed position and the open position in both the first direction and a second direction opposite of the first direction;

wherein the retainer is further configured to pivot between the first position and the second position in the second direction in response to a first pressure applied to a second face of the retainer by a flow of a fluid into the frame in the second direction; and wherein the door is configured to pivot between the closed position and the open position in the second direction in response to a second pressure applied to the first face of the door by the flow of the fluid into the frame in the second direction.

2. The flood vent of claim 1, wherein the first face of the retainer includes a seal.

3. The flood vent of claim 2, wherein the seal comprises a compressible material positionable against the first face of the door.

4. The flood vent of claim 2, wherein the seal comprises one or more ridges positionable against the first face of the door.

5. The flood vent of claim 1, wherein the retainer includes a pivot or hinge coupled to the frame, wherein the pivot or the hinge is configured to allow the retainer to pivot from the first position to the second position.

6. The flood vent of claim 5, wherein the pivot or the hinge is further configured to allow the retainer to pivot from the second position to the first position.

7. The flood vent of claim 1, wherein the retainer includes a fluid modifiable adhesive configured to prevent the retainer from pivoting from the first position to the second position until the fluid modifiable adhesive is modified by the fluid.

8. A flood vent, the vent comprising:

a door pivotable within a frame between a closed position and an open position;

a retainer moveable between a first position and a second position, wherein, in the first position, the retainer is configured to prevent the door from pivoting between the closed position and the open position in a first direction, wherein, in the second position, the retainer is configured to allow the door to pivot between the closed position and the open position in both the first direction and a second direction opposite of the first direction;

wherein the retainer is further configured to move between the first position and the second position in the second direction in response to a first pressure applied to a second face of the retainer by a flow of a fluid into the frame in the second direction; and wherein the door is configured to pivot between the closed position and the open position in the second direction in response to a second pressure applied to a first face of the door by the flow of the fluid into the frame in the second direction.

9. The flood vent of claim 8, wherein the retainer is pivotable between the first position and the second position.

10. The flood vent of claim 9, wherein the retainer includes a pivot or hinge coupled to the frame, wherein the pivot or the hinge is configured to allow the retainer to pivot from the first position to the second position.

11. The flood vent of claim 10, wherein the pivot or the hinge is further configured to allow the retainer to pivot from the second position to the first position.

12. The flood vent of claim 8, wherein the retainer includes a fluid modifiable adhesive configured to prevent the retainer from moving from the first position to the second position until the fluid modifiable adhesive is modified by the fluid.

* * * * *